US008007638B2

(12) United States Patent
Baker et al.

(10) Patent No.: US 8,007,638 B2
(45) Date of Patent: Aug. 30, 2011

(54) SHEET-LIKE PRODUCTS EXHIBITING OLEOPHOBIC AND HYDROPHOBIC PROPERTIES

(75) Inventors: Samuel Baker, Carleton Place (CA); Jackson Graham, Woodlawn (CA); Dietmar Wirtz, Simmerath (DE)

(73) Assignee: AstenJohnson, Inc., Charleston, SC (US)

( * ) Notice: Subject to any disclaimer, the term of this patent is extended or adjusted under 35 U.S.C. 154(b) by 823 days.

(21) Appl. No.: 11/917,589

(22) PCT Filed: Jul. 4, 2006

(86) PCT No.: PCT/CA2006/001097

§ 371 (c)(1),
(2), (4) Date: Dec. 14, 2007

(87) PCT Pub. No.: WO2007/003051

PCT Pub. Date: Jan. 11, 2007

(65) Prior Publication Data

US 2008/0190574 A1 Aug. 14, 2008

(30) Foreign Application Priority Data

Jul. 4, 2005 (GB) ..... 0513699.9

(51) Int. Cl.

| | |
|---|---|
| ***D21H 21/14*** | (2006.01) |
| ***D21H 21/16*** | (2006.01) |
| ***D21H 17/33*** | (2006.01) |
| ***D21H 17/52*** | (2006.01) |
| ***D21H 17/60*** | (2006.01) |
| ***D21H 27/30*** | (2006.01) |
| ***B32B 29/00*** | (2006.01) |

(52) U.S. Cl. ..... 162/158; 162/123; 162/164.1; 162/164.3; 162/164.4; 162/164.5; 162/168.1; 162/135; 162/183; 162/184; 162/169; 162/172; 428/195.1; 428/421

(58) Field of Classification Search ..... 162/123, 162/135, 158, 168.1, 172, 175, 179, 183–185, 162/164.1–164.5, 169; 264/109, 127–128; 428/172, 195.1, 421

See application file for complete search history.

(56) References Cited

U.S. PATENT DOCUMENTS

| | | | | |
|---|---|---|---|---|
| 3,354,022 | A * | 11/1967 | Johnson, Jr. et al. | 428/167 |
| 3,993,640 | A | 11/1976 | Pickard et al. | |
| 4,925,530 | A | 5/1990 | Sinclair et al. | |
| 5,147,507 | A | 9/1992 | Gill | |
| 5,216,097 | A * | 6/1993 | Allewaert et al. | 526/243 |
| 5,330,622 | A | 7/1994 | Honnorat et al. | |
| 5,344,956 | A * | 9/1994 | Allewaert et al. | 560/26 |
| 5,849,447 | A | 12/1998 | Matsuda | |
| 5,932,291 | A | 8/1999 | Sayers et al. | |
| 5,980,986 | A | 11/1999 | Sayers et al. | |
| 5,989,651 | A | 11/1999 | Sayers et al. | |
| 6,551,457 | B2 | 4/2003 | Westman et al. | |
| 6,712,932 | B2 * | 3/2004 | Buchsel et al. | 162/135 |
| 7,208,429 | B2 * | 4/2007 | Vinson et al. | 442/143 |
| 7,285,182 | B2 * | 10/2007 | Mason et al. | 162/135 |
| 7,708,915 | B2 * | 5/2010 | Castor | 264/5 |
| 7,794,784 | B2 * | 9/2010 | Haq et al. | 427/212 |
| 7,842,162 | B1 * | 11/2010 | Lvov et al. | 162/158 |
| 2002/0062938 | A1 * | 5/2002 | Westman et al. | 162/206 |
| 2003/0059599 | A1 | 3/2003 | Beckley et al. | |
| 2003/0127210 | A1 | 7/2003 | Pelletier et al. | |
| 2004/0089433 | A1 * | 5/2004 | Propst et al. | 162/158 |
| 2004/0173329 | A1 * | 9/2004 | Silenius et al. | 162/135 |
| 2004/0221976 | A1 | 11/2004 | Williams et al. | |
| 2004/0226675 | A1 | 11/2004 | Malmstrom et al. | |
| 2005/0053793 | A1 | 3/2005 | Benay-Qun et al. | |
| 2005/0155731 | A1 * | 7/2005 | Martin et al. | 162/158 |
| 2006/0121278 | A1 * | 6/2006 | Vinson et al. | 428/375 |
| 2008/0066880 | A1 * | 3/2008 | Polverari et al. | 162/158 |
| 2008/0128102 | A1 * | 6/2008 | Polverari et al. | 162/168.3 |
| 2008/0190574 | A1 * | 8/2008 | Baker et al. | 162/123 |
| 2009/0020249 | A1 * | 1/2009 | Propst et al. | 162/164.1 |
| 2009/0218060 | A1 * | 9/2009 | Hughes et al. | 162/175 |
| 2009/0226711 | A1 * | 9/2009 | Silvi et al. | 428/331 |
| 2009/0311295 | A1 * | 12/2009 | Mathiowitz et al. | 424/401 |
| 2010/0132901 | A1 * | 6/2010 | Wild | 162/164.1 |
| 2010/0147478 | A1 * | 6/2010 | Propst et al. | 162/168.1 |
| 2010/0186916 | A1 * | 7/2010 | Penniman | 162/173 |
| 2010/0330856 | A1 * | 12/2010 | Baker et al. | 442/93 |

FOREIGN PATENT DOCUMENTS

| | | | |
|---|---|---|---|
| EP | 0277633 | | 10/1988 |
| EP | 0582667 | | 6/1996 |
| GB | 2427868 | A * | 1/2007 |

* cited by examiner

*Primary Examiner* — José A Fortuna
(74) *Attorney, Agent, or Firm* — Volpe and Koenig, P.C.

(57) ABSTRACT

A method of manufacturing a cellulosic sheet having at least one of hydrophobic and oleophobic properties comprises the steps of depositing a stock of cellulosic fibers onto at least one forming fabric at an impingement zone and forming a web therefrom in a formation process; combining a water-based composition comprising an adhesion promoter, an organic nanoparticulate polymer and a fluorocarbon with the web at a preselected combination stage prior to a heating stage at which the web is subjected to a temperature exceeding 60° C.; and heat-curing the composition with the web during a drying process. A water-based composition for imparting at least one of hydrophobic and oleophobic properties to a cellulosic sheet during manufacture comprises an adhesion promoter, an organic nanoparticulate polymer and a fluorocarbon. A cellulosic sheet or layer thereof has at least one of hydrophobic and oleophobic properties. Improved resistance of cellulosic sheets to oil or water is obtained.

17 Claims, No Drawings

SHEET-LIKE PRODUCTS EXHIBITING OLEOPHOBIC AND HYDROPHOBIC PROPERTIES

FIELD OF THE INVENTION

The present invention provides a sol-gel nanoparticle material, and a method of its use, to modify the properties of sheet-type products such as paper so as to increase their hydrophobicity and oleophobicity, thus rendering the products relatively impervious to both water and oils. The sol-gel nanoparticle material may be incorporated into the stock from which the sheet-type products are formed, or it may be applied to one or both surfaces as a coating.

BACKGROUND OF THE INVENTION

Coating treatments intended for application to nonwoven sheet type products, such as paper and related cellulose based products, to provide a physical barrier so as to render them either, or both, hydrophobic and oleophobic, are known. See for example U.S. Pat. No. 5,330,622 to Honnorat et al. Others are known and used.

Similarly, coating treatments to papermaking machine clothing for various purposes are also known, in particular for the provision of a barrier layer to improve the ability of the fabrics to resist staining, adhesion of contaminants, and to improve phase separation, and to increase hydrophobicity.

Recently, for such treatments, use has been made of sol-gel coatings, which are defined as coatings produced by the sol-gel process of glassmaking, in which glass is formed at low temperatures from suitable compounds by chemical polymerization in a liquid phase; a gel is formed from which glass may be derived by the successive elimination of interstitial liquid and the collapse of the resulting solid residue by sintering.

Such sol-gel coatings have been used to form a barrier layer on, amongst other things, woven and nonwoven textile products so as to improve their ability to resist staining and the adhesion of contaminants. Further, it is known to treat papermaking fabrics such as through air dryer (TAD) fabrics with sol-gel coatings so as to increase their hydrophobicity. The coating causes less water to be carried into the TAD section by the fabric and thus the amount of energy used to evaporate water from the sheet is reduced because it is used to dry the sheet, rather than both the sheet and the supporting fabric.

For phase separation devices such as filter cloths, it is now known that organically modified ceramics, known as "ormocers", can advantageously be used. For example, U.S. Pat. No. 5,980,986 to Sayers et al. claims a method of using at least one ormocer as a coating; U.S. Pat. No. 5,932,291 to Sayers et al. claims a method of using the ormocer in papermachine clothing; and U.S. Pat. No. 5,989,651 to Sayers et al. claims a method of using at least one ormocer as a coating to facilitate phase separation by incorporating the ormocer into the polymer melt prior to extrusion, and coating the phase separation apparatus with the extruded polymer melt.

These three related patents refer to the use of an ormocer which contains a perfluorinated material. Those of skill in the art would recognize that these ormocers are organic/inorganic hybrid polymers with a fluorinated material which consist of:

1. a cross-linkable organosilicon (e.g. with epoxy or methacryl groups; see col. 1, lines 50-60 of U.S. Pat. No. 5,932,291), a substance which produces good adhesion with the background (in this case, a fabric) and,
2. an organosilicon with a perfluorinated side chain.

Thus the ormocer consists of a polar and a hydrophobic component and contains ceramic microparticles.

None of the three related patents in this group indicates whether the chemicals used in the coating containing the ormocers are water-based or at least partially solvent-based. However, as at the time of the priority date of these patents (Nov. 16, 1993 and Feb. 1, 1994), only coatings containing solvents were known, the disclosures of these patents can only be regarded as referable to the use of at least partially solvent-based coatings. For imparting desired physical properties to cellulosic products for their specific intended uses, it is also known to introduce optional additives to the stock, prior to its delivery by means of a headbox to an impingement point on a forming fabric. Such additives include fillers and other materials to improve solids retention or opacity. For example, U.S. Pat. No. 5,147,507 to Gill teaches the use of anionic and cationic polymers to reduce the required quantities of a sizing agent and to improve the qualities of filler retention, drainage and opacity; and U.S. Pat. No. 4,925,530 to Sinclair et al. teaches the use of additives for obtaining improved retention. Further, U.S. Pat. No. 6,551,457 to Westman et al. teaches the use of additives to alleviate problems of delamination in processes involving the use of an impulse press unit; in such additives, the anionic polymers can be organic or inorganic, and an organic polymer can include a hydrophobic group.

Further, sizing treatments for the application of sizing agents such as rosin, starch, wax and the like are also known; see, for example, U.S. Pat. No. 3,993,640 to Pickard et al. which discloses the use of cyclic amides for the treatment of cellulosic materials; US 2003/0127210 to Pelletier et al. which teaches the use of water dispersible polyesters; US 2004/0221976 to Williams et al. which teaches the use of hydrophobic polymers; and EP 0 277 633 to Ikeda et al. which teaches the use of starch ether. Other treatments are also known and used.

Additives have also been suggested for improving printability. For example, U.S. Pat. No. 5,849,447 to Matsuda et al. teaches a non-coated paper for ink-jet or electrophotographic printing which contains a mixture of hydrophilic and hydrophobic fibres; and US 2004/0226675 to Malmstrom et al. teaches the addition of polysaccharide with a polymer dispersion for this purpose.

The present inventors have now discovered that it is possible to provide at least one of hydrophobic and oleophobic properties to a paper sheet by adding a water-based sol-gel dispersion containing up to approximately 30% by weight solids, the dispersion being added at any of several points in the papermaking process, up to a location at which curing by heat or other appropriate means can be provided. Thus, the dispersion can be added directly to the stock slurry from which the paper product is made, or it can be applied to the incipient sheet either as a mist, or by other known coating means following formation. Following addition of the water based sol-gel dispersion to the stock slurry, or application of the dispersion to the sheet at a subsequent stage, and subsequently curing the coating on or within the paper product thus formed, penetration of ink into the treated paper sheet is reduced, thus providing for sharper images, reduced or eliminated bleed through to the back side surface of the sheet and potentially a reduction of ink consumed.

Preferably, the water-based sol-gel dispersion is a three-component system consisting of:

1. an adhesion promoter,
2. nanoparticulate material comprised of an organic prepolymer, and
3. a fluorocarbon polymer.

More preferably, the adhesion promoter is an organofunctional adhesion promoter having a functional group which is one of a vinyl-, methacrylate-, epoxy-, amino-, or mercapto-group.

Preferably, the nanoparticulate material is comprised of organic nanoparticles such as nanowaxes including polyethylene or polypropylene, or prepolymers of condensated silanes such as methyltriethoxysilane, propyltriethoxysilane, octyltrimethoxysilane, octyltriethoxysilane, or phenyltrimethoxysilane and the like. An advantage provided by the use of the silane prepolymers is the possibility to react with the adhesion promoter to build a network of organic prepolymer.

Preferably, the fluorocarbon polymer is a fluoroacrylate or fluoralkyl-polyurethane copolymer. Other similar fluorocarbon polymers may be suitable.

These materials are combined in a ratio of from about 10-25% by weight adhesion promoter, 10-25% by weight nanoparticulate material, and from about 30-70% by weight fluorocarbon polymer.

A sol-gel coating material suitable for use in the manufacture of cellulose based sheet-type products such as paper and the like in accordance with the teachings of the present invention is commercially available, as a dilution of 30% by weight of solids in water, under the designation "Sogetec" from Comp-Tex GmbH, Zur Lohe 48, D-52353 Düren, Germany. This product is marketed as a water-based textile impregnation treatment which can impart a permanent hydrophobic and oleophobic character to a treated substrate. We have found that an effective rate of application of the Sogetec and like materials is about 1-10% by weight solids per liter of water.

A designation of "Sogetec" which has been found to be particularly suitable for this process has been found to be Sogetec 041/30. Other similar treatments containing a three-component water-based sol-gel dispersion system, as discussed above, may be suitable to impart these hydrophobic and/or oleophobic properties to sheet type cellulosic based products such as paper, board and the like, and may include X-Clean® Textile Protect VP-V1/1/KNK-10 which is available from Nano-X GmbH of Theodore Heuss Strasse 11a, Saarbruecken, Germany.

The treated material is then cured at a temperature of from about 60° C. to about 210° C. so as to render the nanoparticle treatment effective. An increased durability of the treatment has been found where the curing temperatures are in the range of from about 100° C. to 200° C.

The additive dispersions of the invention differ from the prior art additives in several respects. Firstly, the dispersions contain two separate systems which do not react with each other, i.e. they neither build up covalent bonds nor do they combine in the form of an alloy. The thin film of fluorocarbon resin especially selected for the purpose, preferably fluoroacrylate precipitated on same is considerably thinner than in the case of a coating consisting exclusively of a fluorocarbon resin. Further, the hydrophobic component in the additive dispersions of the invention bears no relation to any component of the ormocers of the prior art, and comprises no inorganic (i.e. ceramic) microparticles.

Further, the fluorocarbon resins of the additive dispersions of the invention are specifically designed for use together with organosilicon products, and are entirely distinguishable from the perfluorinated side chains of the fluorosilane taught by U.S. Pat. No. 5,932,291.

Experimental Work

The sheet forming process was replicated in the laboratory using a gravity sheet former. In this apparatus, a stock solution is passed under gravity through a known forming fabric and a paper web is thus formed on the fabric surface. The sheet so formed is then dried, removed from the forming fabric, and examined. In the experimental work conducted to determine the effects of the nanoparticle material on the papermaking process, repulped computer paper was used as a fiber source to form a handsheet having a basis weight of from about 20 to 25 gsm (grams per square meter).

In the experiment, 0.1% by weight of solids of the Sogetec 041/30 material (i.e. 0.3% of the liquid) was added to the pulp slurry which contained the repulped papermaking fibers and water in appropriate amounts. Stock which did not contain any of the Sogetec 041/30 material was used as a control. Handsheets (i.e. small paper sheets formed on the fabric) were formed from this dilution using the gravity sheet former as described above. Both the experimental and control handsheets were then dried under identical conditions at temperatures of about 105° C. This drying at elevated temperature also served to cure the Sogetec 041/30 material in the experimental handsheet. Droplets of oil and, separately, water were then applied to the surface of each of the experimental and control handsheets.

It was found that handsheets made from pulp stock containing about 0.1% by weight of the solids of the Sogetec 041/30 material resisted the application of oil and water as compared to the control sheets which did not resist and absorbed each of those liquids immediately. Examination of the experimental and control handsheets showed that droplets of oil and water which were applied to the surfaces of the experimental handsheets containing 0.1% by weight of the solids of the Sogetec 041/30 material remained beaded on the surface of the sheet for several hours and did not penetrate beneath the surface of the sheet. Such effects were observed in concentrations of the particulate material as low as 1.0 ppm (parts per million). By comparison, handsheets which did not contain any of the Sogetec 041/30 material absorbed each liquid immediately.

The Sogetec 041/30 sol-gel material was also applied in an experimental process by first drying the paper sheet, then dip-coating the sheet in about a 0.1% by weight of solids concentration of the Sogetec 041/30, followed by re-drying the sheet; it was found that this method of application produced substantially the same results as described above. Another method of application that was used in experimental testing was to mist the handsheet with an aerosol liquid containing about 0.1% by weight of the solids of the Sogetec 041/30 in water, the misting being by means of a spray applicator onto the non-fabric-contacting side of the wet sheet. The sheet was then dried and cured. In a second instance of the same experiment, the 0.1% by weight of the solids of the Sogetec 041/30 in water was misted onto a dry sheet which was subsequently redried. This second misting method, i.e. misting onto a dried sheet and then redrying and curing it, appears to produce a "one sidedness" to the barrier properties (in other words, only one side of the sheet seems to inherit the barrier properties).

After preparation and initial testing of the cured treated sheets, further testing was performed by applying drops of oil and water on the sheets over a period of several weeks. In each case, the barrier effect persisted. When printing ink was applied to the cured treated sheets in the usual manner, the sheets exhibited no bleed-through and the written image was sharper than on the untreated control sheets.

Thus, nonwoven sheet type products, in particular paper and similar cellulose based products, are rendered both hydrophobic and oleophobic by the incorporation of a nanoparticle material that is formed by a sol-gel type process and is composed of nanowax or condensated silane prepolymer reacted during a curing process with a fluoroamine. This material can be incorporated in small amounts into the stock from which these cellulosic sheet products are formed, or the cellulosic sheet can be treated, prior to a drying stage, by a conventional mist application of a water-based solution containing the nanoparticle material, or by dip coating the sheet in such water based solution containing the nanoparticle material. Regardless of the method by which the nanoparticle material is incorporated into or applied onto the product, it is necessary to expose the sheet-type product to heat so as to cure the nanoparticle material and thus provide the resultant enhancement in barrier properties. After curing, the nanoparticle material imparts a hydrophobic and oleophobic character to the sheet, which assists in resisting penetration by both water and oils.

SUMMARY OF THE INVENTION

In a first broad embodiment, the invention therefore seeks to provide a method of manufacturing a cellulosic sheet having at least one of hydrophobic and oleophobic properties, the method comprising (i) depositing a stock of cellulosic fibres onto at least one forming fabric at an impingement zone and forming a web therefrom in a formation process;

(ii) combining a water-based composition comprising an adhesion promoter, an organic nanoparticulate polymer and a fluorocarbon with the web at a preselected combination stage prior to a heating stage at which the web is subjected to a temperature exceeding 60° C.; and (iii) heat-curing the composition with the web during a drying process.

In this embodiment, the water-based composition material is preferably incorporated into the stock as an additive at some location upstream of the point of impingement in amounts of from 0.001% to 1% by weight of stock. Thereafter, a cellulosic product can be formed according to known methods. However, it is also possible to incorporate stock containing the water-based composition additive material as a single layer in a multi-ply paper structure; the treated stock could be used, for example, as an inner barrier layer, or as one or both outer layers of a multi-layer paper product. Regardless of the location of the stock containing the additive material, the resultant sheet must be subjected to heat so as to cure the additive material.

In a variant of this embodiment, the water-based composition material is applied as a mist to one side, or both sides, of the sheet during the formation process (i.e. while the sheet is very wet), resulting in a coating of the sheet. The sheet is then dried in the normal sheet drying process, and the coating is heat-cured either as a separate process or within the normal sheet drying process.

In a second broad embodiment, the invention further seeks to provide a composition for imparting at least one of hydrophobic and oleophobic properties to a cellulosic sheet during manufacture, comprising an adhesion promoter, an organic nanoparticulate polymer and a fluorocarbon.

In a third broad embodiment, the invention further seeks to provide a cellulosic sheet having at least one of hydrophobic and oleophobic properties, and being manufactured as a web from a stock of cellulosic fibres wherein the web is combined with a water-based composition comprising an adhesion promoter, an organic nanoparticulate polymer and a fluorocarbon.

In each of the embodiments of the invention, the adhesion promoter in the water-based composition is preferably an organofunctional silane, the functional group of which is preferably selected from vinyl-, epoxy-, amino-, mercapto- and methacrylate. The organic nanoparticulate polymer is preferably selected from nanowaxes of polyethylene or polypropylene, or prepolymers of one of a condensated silanes, which are preferably selected from methyltriethoxysilane, propyltriethoxysilane, octyltrimethoxysilane, octyltriethoxysilane, or phenyltrimethoxysilane. The fluorocarbon is preferably selected from a fluoracrylate and a fluoralkyl-polyurethane copolymer.

In the water-based composition material, the three principal components discussed above are preferably present in the ranges of 10-25% adhesion promoter; 10-25% organic nanoparticles; and 30-70% of a fluorocarbon.

In each of the embodiments of the invention, the heat-curing of the water-based composition material is preferably conducted at a temperature in a range of about 60° C. to about 210° C.; and more preferably in a range of about 100° C. to 200° C.

As noted above, the treated cellulosic sheets of the invention can comprise one or more layers in a multi-ply sheet structure, and in a fourth broad embodiment the invention seeks to provide a multi-layer cellulosic sheet having at least one of hydrophobic and oleophobic properties, at least one layer being manufactured as a web from a stock of cellulosic fibres wherein the web is combined with a water-based composition comprising an adhesion promoter, an organic nanoparticulate polymer and a fluorocarbon.

We claim:

1. A method of manufacturing a cellulosic sheet having at least one of hydrophobic and oleophobic properties, the method comprising (i) depositing a stock of cellulosic fibres onto at least one forming fabric at an impingement zone and forming a web therefrom in a formation process;

(ii) combining a water-based composition comprising an adhesion promoter, an organic nanoparticulate polymer and a fluorocarbon with the web at a preselected combination stage prior to a heating stage at which the web is subjected to a temperature exceeding 60° C., wherein in the water-based composition the adhesion promoter is an organofunctional silane, the organic nanoparticulate polymer is selected from nanowaxes of polyethylene or polypropylene, and prepolymers of a condensated silane, and the fluorocarbon is selected from the group consisting of a fluoroacrylate and a fluoralkyl-polyurethane copolymer; and (iii) heat-curing the composition with the web during a drying process.

2. A method as claimed in claim 1, wherein the water-based composition is combined with the web by coating at least one side of the web during the formation process.

3. A method as claimed in claim 1, wherein the water-based composition is combined with the web by addition to the stock prior to the deposit at the impingement zone.

4. A method as claimed in claim 3, wherein solids of the water-based composition after addition to the stock are present in the stock in a range of 0.001% to 1%.

5. A method as claimed in claim 4, comprising the further step of incorporating at least one of the sheets into a multi-layered cellulosic sheet.

6. A method as claimed in claim 1, wherein the functional group of the organofunctional silane is selected from the group consisting of vinyl-, epoxy-, amino-, mercapto- and methacrylate.

7. A method as claimed in claim 1, wherein in the water-based composition the adhesion promoter is present in a range of between 10% and 25%, the organic nanoparticulate polymer is present in a range of between 10% and 25%, and the fluorocarbon is present in the range of between 30% and 70% by weight.

8. A method as claimed in claim 1, wherein the condensated silane is selected from the group consisting of methyltriethoxysilane, propyltriethoxysilane, octyltrimethoxysilane, octyltriethoxysilane and phenyltrimethoxysilane.

9. A method as claimed in claim 1, wherein the step of heat-curing is conducted at a temperature in a range between 60° C. and 210° C.

10. A method as claimed in claim 1, wherein the step of heat-curing is conducted at a temperature in a range between 100° C. and 200° C.

11. A cellulosic sheet having at least one of hydrophobic and oleophobic properties, and being manufactured as a web from a stock of cellulosic fibres wherein the web is combined with a water-based composition comprising an adhesion promoter, an organic nanoparticulate polymer and a fluorocarbon, wherein the adhesion promoter is an organofunctional silane, the organic nanoparticulate polymer is selected from the group consisting of nanowaxes of polyethylene or polypropylene, and prepolymers of a condensated silane, and the fluorocarbon is selected from the group consisting of a fluoroacrylate and a fluoralkyl-polyurethane copolymer.

12. A cellulosic sheet as claimed in claim 11, wherein the water-based composition is combined into the stock.

13. A cellulosic sheet as claimed in claim 11, wherein the water-based composition is coated onto the web.

14. A cellulosic sheet as claimed in claim 11, wherein the functional group of the organofunctional silane is selected from the group consisting of vinyl-, epoxy-, amino-, mercapto- and methacrylate.

15. A cellulosic sheet as claimed in claim 11, wherein the condensated silane is selected from the group consisting of methyltriethoxysilane, propyltriethoxysilane, octyltrimethoxysilane, octyltriethoxysilane and phenyltrimethoxysilane.

16. A cellulosic sheet as claimed in claim 11, wherein in the water-based composition the adhesion promoter is present in a range of between 10% and 25%, the organic nanoparticulate polymer is present in a range of between 10% and 25%, and the fluorocarbon is present in the range of between 30% and 70% by weight.

17. A multi-layer cellulosic sheet having at least one of hydrophobic and oleophobic properties, at least one layer being manufactured as a web from a stock of cellulosic fibres wherein the web is combined with a water-based composition comprising an adhesion promoter, an organic nanoparticulate polymer and a fluorocarbon, wherein the adhesion promoter is an organofunctional silane, the organic nanoparticulate polymer is selected from the group consisting of nanowaxes of polyethylene or polypropylene, and prepolymers of a condensated silane, and the fluorocarbon is selected from the group consisting of a fluoroacrylate and a fluoralkyl-polyurethane copolymer.

* * * * *